US007563076B2

(12) United States Patent
Brunet et al.

(10) Patent No.: US 7,563,076 B2
(45) Date of Patent: Jul. 21, 2009

(54) VARIABLE RATE PUMPING SYSTEM

(75) Inventors: John Dexter Brunet, Duncan, OK (US); David Mark Stribling, Duncan, OK (US); Todd J. Dean, Comanche, OK (US); James D. Roach, Duncan, OK (US); Stephen Franklin Crain, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 820 days.

(21) Appl. No.: 10/974,437

(22) Filed: Oct. 27, 2004

(65) Prior Publication Data

US 2006/0088423 A1 Apr. 27, 2006

(51) Int. Cl.
*F04B 49/00* (2006.01)
*F01B 31/14* (2006.01)

(52) U.S. Cl. ..... 417/218; 417/212; 92/13.1

(58) Field of Classification Search ..... 417/212, 417/218; 92/13, 13.1, 13.7
See application file for complete search history.

(56) References Cited

U.S. PATENT DOCUMENTS

| | | | | |
|---|---|---|---|---|
| 0,635,258 | A | 10/1899 | Lange | |
| 2,792,156 | A | 5/1957 | Camp | |
| 2,873,611 | A | 2/1959 | Biermann | |
| 3,738,230 | A | 6/1973 | Censi | 92/13.3 |
| 3,834,839 | A | 9/1974 | Krebs et al. | 417/505 |
| 4,028,018 | A | 6/1977 | Audsley | 417/534 |
| 4,131,094 | A | 12/1978 | Crise | |
| 4,240,386 | A | 12/1980 | Crist | |
| 4,264,281 | A | 4/1981 | Hammelmann | |
| 4,346,677 | A | 8/1982 | Nye | |
| 4,682,532 | A | 7/1987 | Erlandson | 92/13.7 |
| 4,778,355 | A * | 10/1988 | Holland | 417/378 |
| 4,830,589 | A | 5/1989 | Pareja | 417/539 |
| 5,136,987 | A | 8/1992 | Schechter et al. | |
| 5,335,632 | A | 8/1994 | Hefley | |
| 6,397,794 | B1 | 6/2002 | Sanderson et al. | 123/48 |
| 6,446,587 | B1 | 9/2002 | Sanderson et al. | 123/56.1 |
| 6,715,995 | B2 * | 4/2004 | Kelm et al. | 417/12 |
| 6,742,441 | B1 | 6/2004 | Surjaatmadja et al. | 92/13.7 |
| 2006/0088425 | A1 | 4/2006 | Lucas et al. | |

OTHER PUBLICATIONS

Office Action dated Sep. 18, 2007 (8 pages), U.S. Appl. No. 10/974,577, filed Oct. 27, 2004.
Office Action dated Jan. 17, 2008 (6 pages), U.S. Appl. No. 10/974,577, filed Oct. 27, 2004.
U.S. Appl. No. 10/603,482, filed Jun. 25, 2003, Hunter.
2002-IP-008137, Lucas et al.
US 6,019,073, 02/2000, Sanderson (withdrawn)

* cited by examiner

*Primary Examiner*—Charles G Freay
*Assistant Examiner*—Patrick Hamo
(74) *Attorney, Agent, or Firm*—John W. Wustenberg; Conley Rose, P.C.

(57) ABSTRACT

A pumping system comprising a motor, wherein the motor has an operating speed, a pump coupled to the motor, wherein the pump has a volumetric displacement, a fluid end coupled to the pump, wherein the fluid end is operable to draw fluid from an input and provide fluid to an output, and a control system operable to regulate the motor and the pump in order to provide fluid to the output at a selected pressure and flow rate within a continuous range of pressures and flow rates between the peak horsepower output and peak torque output of the motor.

22 Claims, 6 Drawing Sheets

VARIABLE RATE PUMPING SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

The present invention relates generally to methods and apparatus for supplying pressurized fluids. More particularly, the present invention relates to methods and apparatus for pumping fluids into a wellbore at a wide range of pressures and flow rates.

The construction and servicing of subterranean wells often involves pumping fluids into the well for a variety of reasons. For example, fluids may be pumped into a well in conjunction with activities including fracturing, completion, stimulation, remediation, cementing, workover, and testing operations. A variety of fluids used in these operations include fracturing fluids, gels, drilling mud, barite, cement, slurries, acids, and liquid $CO_2$. In each of these different applications, the fluid may be required to be pumped into the well at any point within a wide range of pressures and flow rates.

Pumping units often utilize a power source, such as a diesel or electric motor, to drive one or more pumps. Many pumping units utilize a multispeed transmission connected between the power source and the pumps. The transmission operates to expand the speed and torque range produced by the power source by providing a set number of gears that transfer the motion produced by the power source to the pump.

Most multispeed transmissions provide a broad operating envelope of speed and torque within which a pump can operate. This operating envelope 10 can be illustrated as a relationship between pressure and flow rate as is shown in FIG. 1. Line 15 defines the peak hydraulic horsepower at which the pump can operate and line 16 defines the peak torque output. Because the transmission comprises a limited set of gear ratios 17, the operating envelope 10 of the pump has discreet points 20 at which the pump can operate at peak hydraulic horsepower. These discreet points 20, in effect, create gaps 25 where the pump cannot operate with a given gearing.

Although gaps 25 can be reduced by increasing the numbers of gear ratios within a transmission, as the number of gear ratios increases so does the complexity and weight of the transmission. Therefore, there are often practical limits on the number of gear ratios at which a transmission can operate. Thus, there remains a need to develop methods and apparatus for pumping fluids into a wellbore at wide range of pressures and flow rates, which overcome some of the foregoing difficulties while providing more advantageous overall results.

SUMMARY

Disclosed herein is a wellbore pumping system comprising a motor, wherein the motor has an operating speed, a pump coupled to the motor, wherein the pump has a volumetric displacement, a fluid end coupled to the pump, wherein the fluid end is operable to draw fluid from an input and provide fluid to an output that is in fluid communication with a wellbore, and a control system operable to regulate the motor and the pump in order to provide fluid to the output at a selected pressure and flow rate within a continuous range of pressures and flow rates between the peak horsepower output and peak torque output of the motor.

Further disclosed herein is a method for operating a wellbore pumping system, the method comprising operating a pumping system to provide fluid to a wellbore at a selected pressure and flow rate operating conditions within a continuous range of pressures and flow rates between the peak horsepower and peak torque of the pumping system, monitoring the pressure and flow rate of the fluid provided by the pumping system, and controlling the pumping system to provide non-discreet variations in the pressure and flow rate of the fluid provided to the wellbore. Further disclosed herein is a pumping system comprising a motor having an operating speed, a variable displacement pump coupled to the motor, wherein the positive displacement pump has an operating speed that is related to the operating speed of the motor by a fixed ratio, a fluid end coupled to the pump, wherein the fluid end is operable to draw fluid from an inlet and provide fluid to an outlet that is in fluid communication with a wellbore, and a control system operable to regulate the operating speed of the motor and the displacement of the pump so as to control the pressure and flow rate of the fluid provided to the outlet.

Further disclosed herein is a method of operating a wellbore servicing pump comprising controlling the operating parameters of the pump to provide a fluid output at any combination of pressure and flow rate within a range defined by the peak hydraulic horsepower, the peak torque, the maximum pressure, and the maximum flow rate of the pump, monitoring pressure and flow rate of the fluid output, adjusting at least one of the operating parameters of the pump to provide a desired pressure and flow rate of the fluid output.

Thus, the present invention comprises a combination of features and advantages that enable it to overcome various problems of prior devices. The various characteristics described above, as well as other features, will be readily apparent to those skilled in the art upon reading the following detailed description of the invention, and by referring to the accompanying drawings.

BRIEF DESCRIPTION OF THE DRAWINGS

For a more detailed description of the present invention, reference will now be made to the accompanying drawings, wherein.

DETAILED DESCRIPTION

Figure 2:
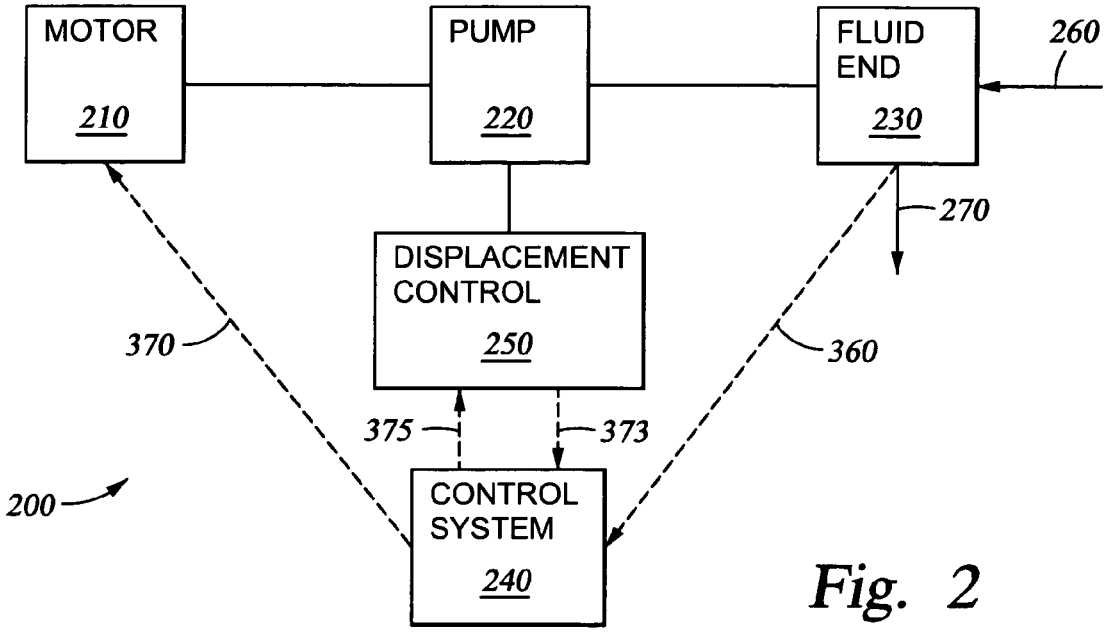
FIG. 2 is a schematic illustration of a pumping system constructed in accordance with embodiments of the invention.

Referring now to an embodiment shown in FIG. 2, pump system 200 comprises motor 210, pump 220, fluid end assembly 230, control system 240, and displacement control 250. Motor 210 is coupled to pump 220 and provides power to the pump. Pump 220 works through fluid end assembly 230 to pull fluid from inlet 260 to outlet 270. Control system 240 monitors the flow conditions (e.g. flow rate and pressure) at outlet 270 and regulates motor 210 and pump 220, through displacement control 250, to maintain a desired flow rate and pressure.

Pump 220 is linked to motor 210 without a transmission, such that their speeds are related by a fixed ratio. Thus, the speed of pump 220 may be directly regulated by controlling the speed of motor 210. Displacement control 250 regulates the displacement (or volume of fluid) that pump 220 will move with each revolution or reciprocation. For example, displacement control 250 may act to vary the displacement of pump 220 by changing the volume of fluid pumped per stroke of a pump cylinder.

Figure 3:
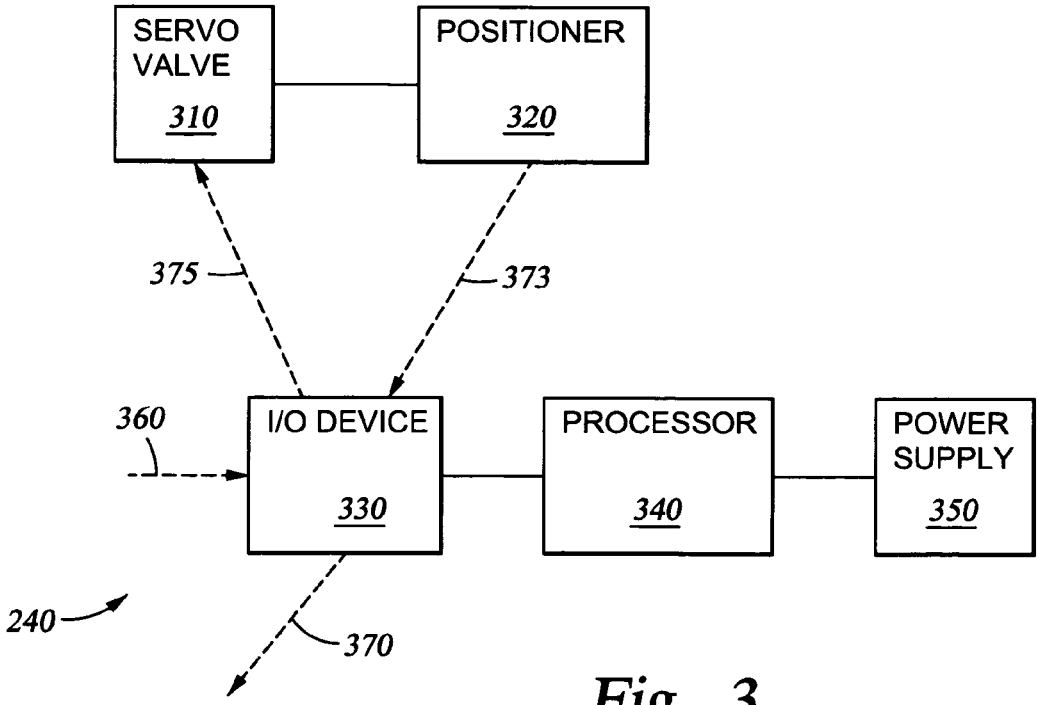
FIG. 3 is a schematic illustration of a control system for a pumping system constructed in accordance with embodiments of the invention.

One embodiment of control system 240 is shown in FIG. 3. Control system 240 comprises servo valve 310, positioner 320, input/output (I/O) device 330, processor 340, and power supply 350. Servo valve 310 and positioner 320 may be integrated into displacement control 250 of FIG. 2. Servo valve 310 may be an electric, hydraulic, or electro-hydraulic valve providing control of positioner 320. Positioner 320 may be an electric or hydraulic actuator operable to interface with a displacement determining arrangement within pump 220. I/O device 330 monitors the position of positioner 320 via line 373 and regulates the operation of servo valve 310 via line 375 in order to control the position of the positioner. I/O device 330 controls the position of positioner 320 in response to flow data 360 received from outlet 270 (see FIG. 2). Processor 340, powered by power supply 350, controls the activity of I/O devices 330 in response to operator inputs or from a pre-programmed procedure. I/O devices 330 may comprise two separate devices, one for position input, and one for servo valve output, such as SDS CAN analog input and output modules. Processor 340 may be an ACE industrial PC with a board that connects the PC to the I/O devices 330.

Referring now to FIGS. 2 and 3, and by way of example, processor 340 receives an instruction to provide a fluid output having a desired flow rate and pressure from fluid end assembly 230. Processor 340 determines a motor speed and pump displacement that will provide the desired fluid output by referencing a predetermined reference table or by calculating the appropriate values. Processor 340 transmits the corresponding predetermined motor speed and pump displacement drive signals for the desired flow conditions to I/O devices 330. I/O devices 330 send instructions to displacement control 250 via line 375 and motor 210 via line 370. Displacement control 250 establishes the displacement for pump 220 by setting positioner 320 using servo valve 310. Speed control commands 370 are issued to motor 210 from I/O device 330 of control system 240.

As pump 220 operates, I/O device 330 receives flow data 360 from outlet 270 and adjusts motor 210 and displacement control 250 to maintain the desired flow characteristics. The motor speed and displacement can be optimized for horsepower, torque, fuel efficiency, or a combination of those factors. For example, if maximum horsepower is selected, the engine speed (and thus pump speed) and pump displacement would be chosen to give the best rate for maximum engine horsepower to be developed. Thus, maximum horsepower would be transferred to the pump and to the fluid being pumped. Similar choices could be made for optimal efficiency, or for optimal torque. In each case, the engine speed and displacement would be chosen to allow for the optimum parameter value to be developed by the engine and transferred to the pump with much lower loss than with a transmission. So, for example, if optimum efficiency is chosen, the engine speed and the pump stroke (displacement) would be chosen to allow the engine to operate at optimum efficiency, saving fuel and reducing emissions. The efficiency would be greater not only because of operation the engine at its optimal speed for the load but would also be greater than with a transmission because losses from the transmission, which lower efficiency, would be avoided.

A continuous feedback control loop also allows for adjusting to changing fluid conditions, including compressibility and inlet flow rate, and provides a quick-to-neutral capability. The quick-to-neutral capability offers a significant advantage should a pumping shutdown be needed. When activated, a relief valve would quickly release the hydraulic pressure that was holding the current pump displacement and fluid back pressure would rapidly stroke the positioner back to the zero rate pumping position. This could be done much more quickly than stopping the engine or pump from rotating, because to stop them their inertia must be overcome. This ability could be further enhanced by incorporating a spring in the displacement actuator so that when pumping against low pressure the spring would assist in more rapidly returning the pump to the zero pumping rate position.

Figure 1:
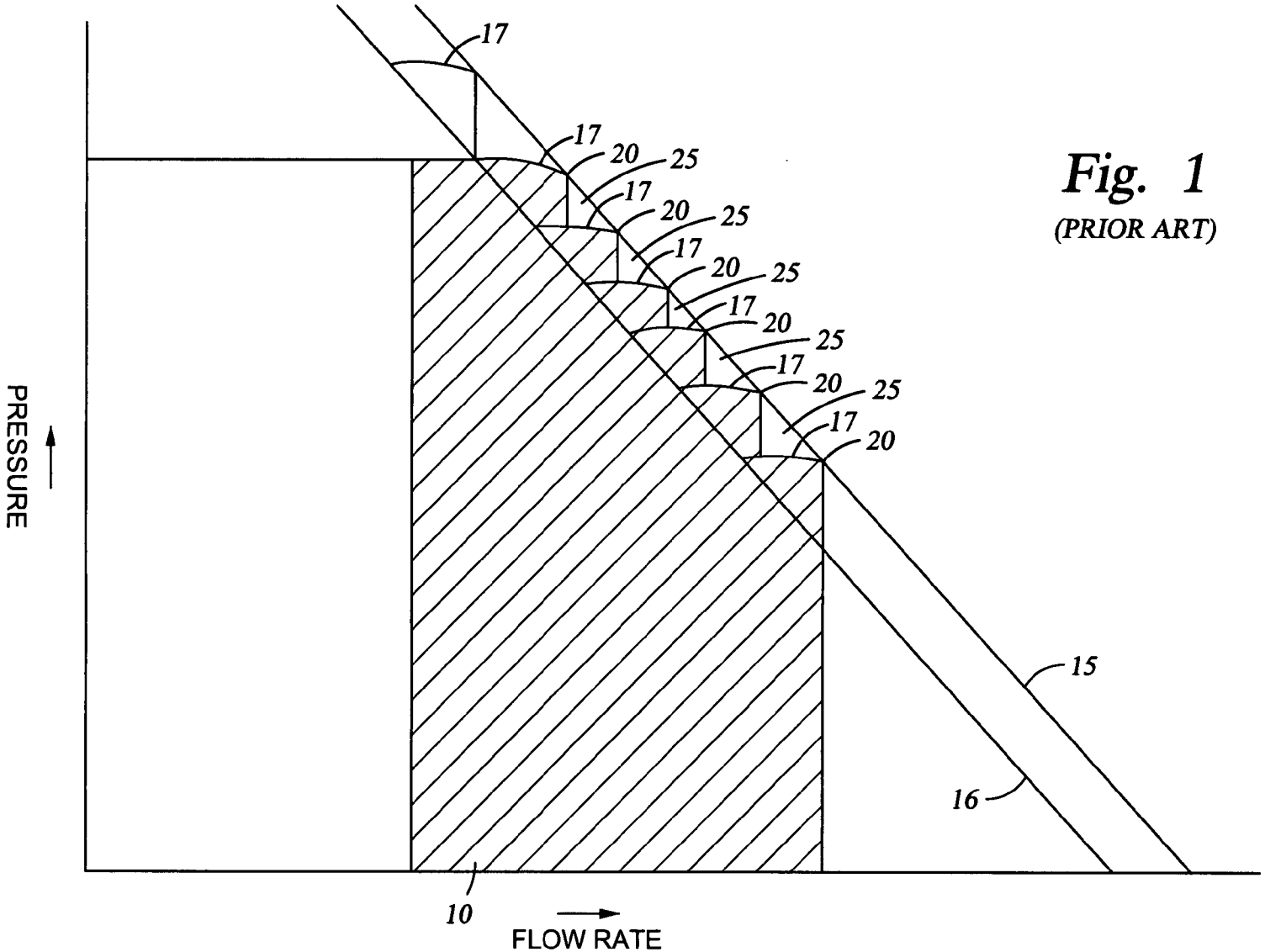
Fig. 1 (PRIOR ART)
FIG. 1 is a graphical representation of the output characteristics of a prior art pumping system employing a multispeed transmission.
Figure 4:
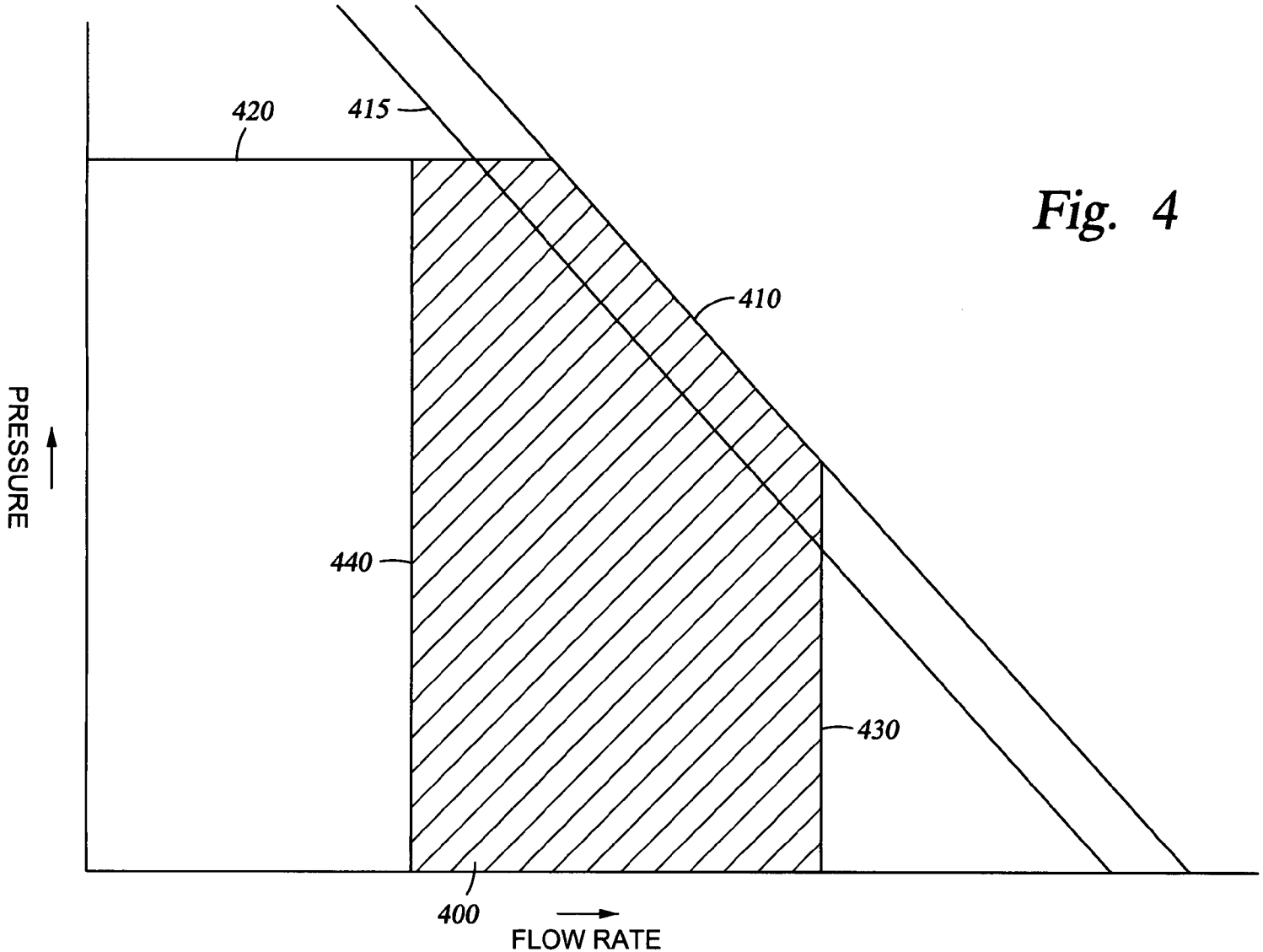
FIG. 4 is a graphical representation of the output characteristics of a pumping system constructed in accordance with embodiments of the invention.

By controlling the speed of motor 210 and the displacement of pump 220 any desired pressure and flow rate combination within a given operating envelope can be provided at outlet 270. Referring now to FIG. 4, an operating envelope 400 for pump system 200 can be illustrated as a relationship between pressure and flow rate. Because there are no distinct gear ratios, as are shown in FIG. 1, operating envelope 400 includes all pressure and flow rate combinations within the operational limits of peak hydraulic horsepower 410, peak torque output 415, maximum operating pressure 420, maximum flow rate 430, and minimum flow rate 440. Therefore, pump system 200 can operate within a continuous range of pressure and flowrate combinations between peak hydraulic horsepower 410 and peak torque output 415. When compared to the prior art multispeed transmission operating envelope of FIG. 1, the operating envelope of FIG. 4 has no gaps between peak hydraulic horsepower 410 and peak torque output 415 where there are pressure and flow rate combinations where the system cannot operate.

Eliminating the multispeed transmission also eliminates a complex piece of machinery, reducing capital and maintenance costs as well as reducing the weight of the overall system. Many pumping systems are portable systems that are mounted on skids, trailers, or chassis, so weight and size of components is an important issue. For example, to be easily transported by road, the size of a portable component of a system is limited to a width of approximately eight feet and a height of approximately thirteen feet. With the weight of the multispeed transmission eliminated, a higher horsepower or capacity system could be used in applications that were previously limited by the weight and/or size of the components.

Embodiments of pumping system 200 may utilize any combination of motors, variable displacement pumps, and fluid end assemblies as may be desired. For example, an electric or diesel motor may be used to provide power to the pump. The pump may be any variable displacement pump providing easily adjusted variable displacement and capable of the horsepower and pressure requirements needed for the desired application. For example, pumps may be used having mechanisms as described in U.S. Pat. No. 6,742,441, entitled "Continuously Variable Displacement Pump with Predefined Unswept Volume," or U.S. patent application Ser. No. 10/603,482 filed Jun. 25, 2003, entitled "Transmissionless Variable Output Pumping Unit," or U.S. patent application filed concurrently herewith, Docket Number HES 2002-IP-008137U1, entitled "Variable Stroke Assembly," all of which are incorporated herein by reference in their entirety for all purposes.

Figure 5:
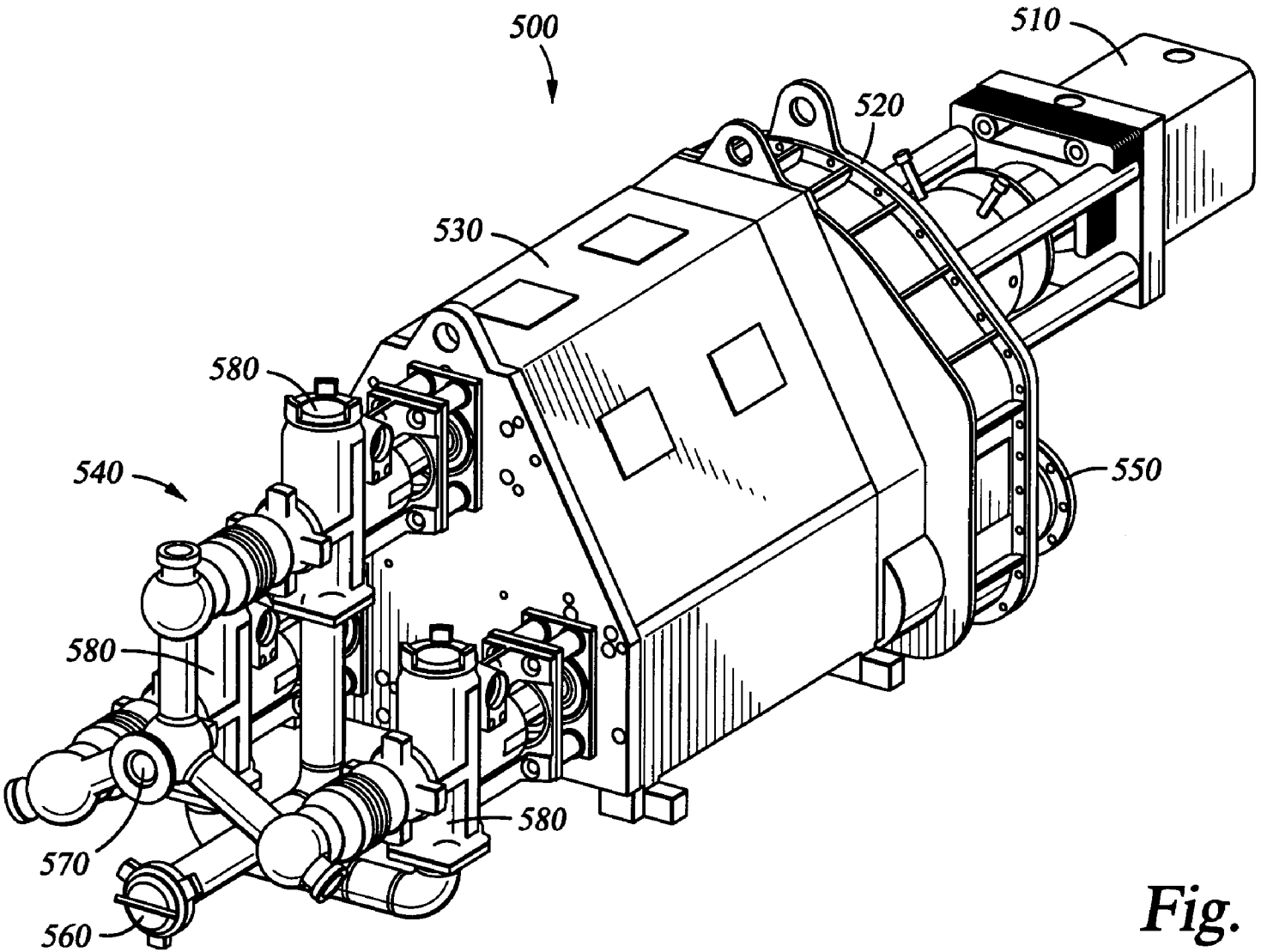
FIG. 5 is an isometric view of one embodiment of a pumping system constructed in accordance with embodiments of the invention.

Referring now to FIG. 5, one embodiment of a pump system 500 is shown including displacement controller 510, speed reducer 520, variable displacement pump 530, and fluid end 540. Pump system 500 is powered by an electric motor or diesel engine (not shown) through drive line connection 550. Variable displacement pump 530 comprises a "Sanderson mechanism" as is shown and described in U.S. Pat. No. 6,019,073, entitled "Double Ended Piston Engine," and U.S. Pat. No. 6,397,794, entitled "Piston Engine Assembly," and U.S. Pat. No. 6,446,587, entitled "Piston Engine Assembly," all of which are incorporated herein by reference in their entirety for all purposes.

Variable displacement pump 530 includes a rotating shaft, the position of which can be linearly adjusted to control the displacement of the pump. The shaft is rotated by the motor turning drive line connection 550, which is coupled to the shaft through speed reducer 520. Speed reducer 520 transfers rotation from drive line connection 550 to the shaft at a fixed ratio as established by one or more gears disposed within the speed reducer. Thus, the rotational rate of pump 530 is directly proportional to the rotational rate at which the motor is operated.

The displacement of pump 530 is controlled by axially displacing the rotating shaft that is coupled to the motor. The displacement of the rotating shaft can be controlled by a variety of devices including hydraulic cylinders, jack-screws, ball-screws, pneumatic cylinders, and electric actuators. These devices preferably provide adjustment of the rotating shaft in both directions along its axis. Referring back to FIG. 3, these control devices act as positioner 320 that is controlled by servo 310.

Figure 6:
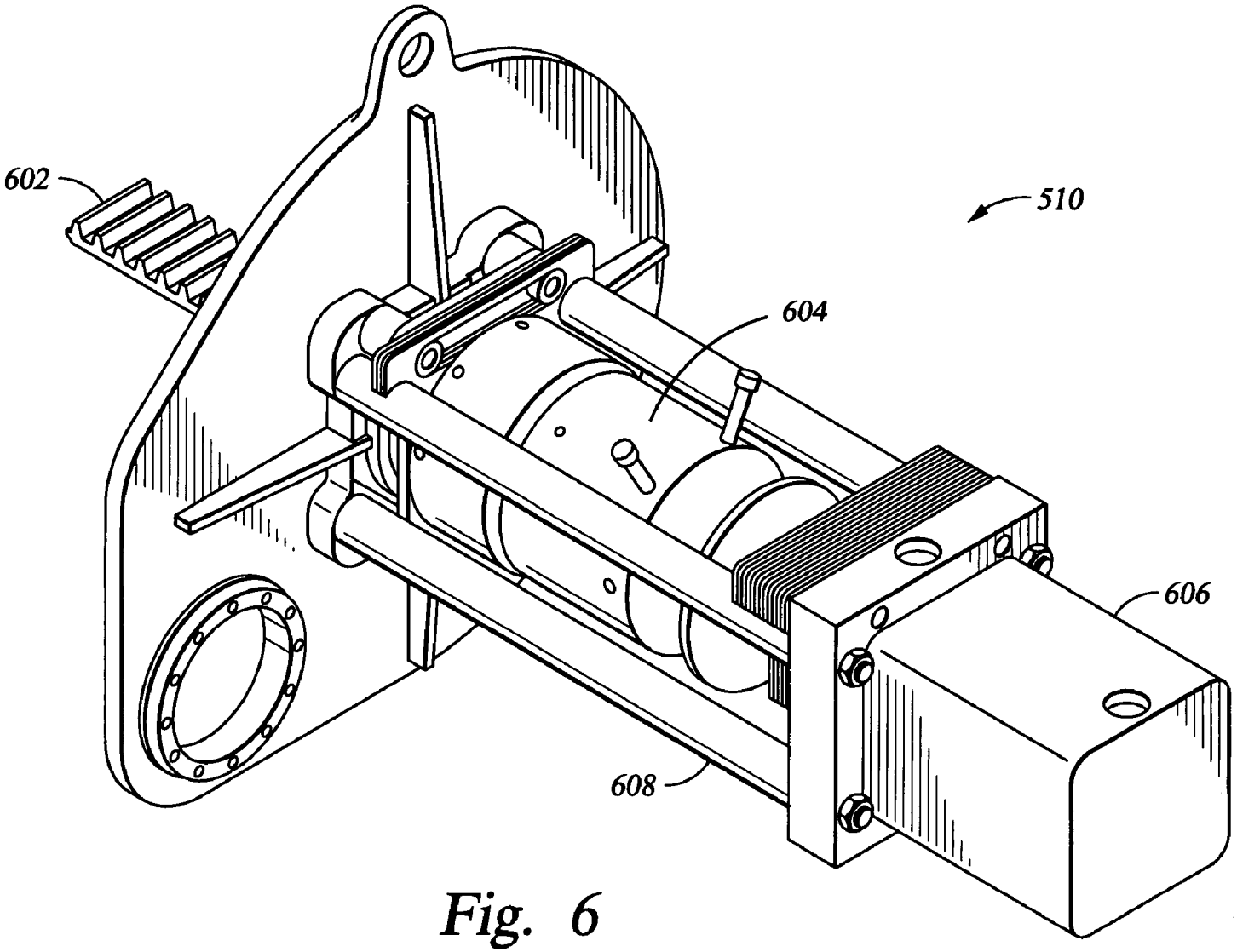
FIG. 6 is an isometric view of the displacement controller of FIG. 5.

As shown in FIG. 6, displacement controller 510 controls the linear displacement of the rotating shaft 602. Displacement controller 510 includes coupler 604 that interfaces between shaft 602 and hydraulic piston 606. Hydraulic piston 606 is connected to the power end of pump 530 by tie rods 608. Coupler 604 supports rotational movement of shaft 602 and allows hydraulic piston 606 to apply an axial force to move shaft 602 and thus adjust the stroke of pump 530.

Figure 7:
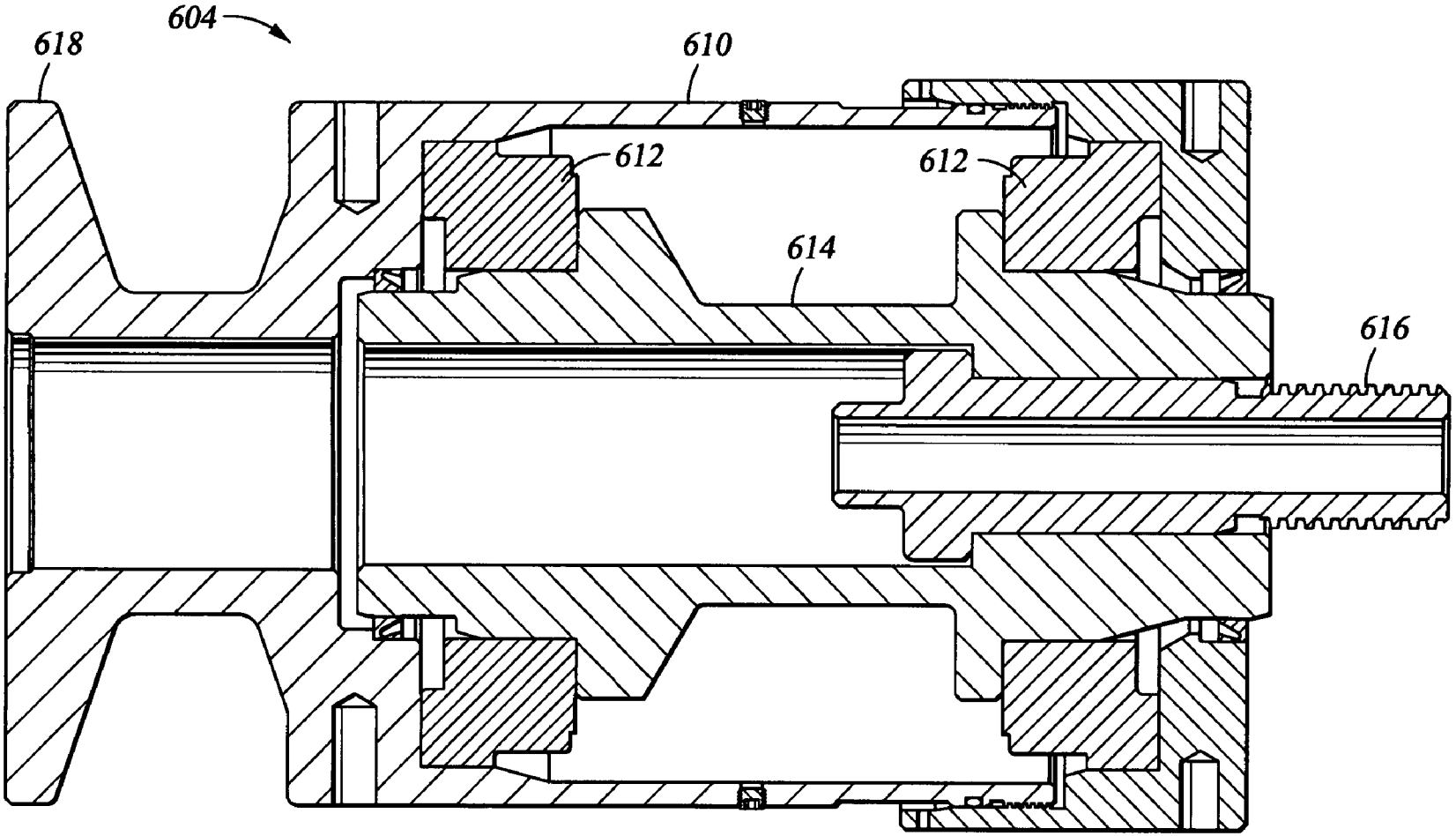
FIG. 7 is a cross-sectional view of a coupler of the displacement controller of FIG. 5.

Referring now to FIG. 7, coupler 604 includes housing 610, bearings 612, rotating retainer 614, and connecting screw 616. Housing 610 is mounted to pump 530 and includes flange 618. The extending shaft of hydraulic piston 606, see FIG. 6, engages flange 618 to apply linear force to housing 610. Shaft 602, see FIG. 6, is attached to screw 616, which is connected to rotating retainer 614 and allowed to rotate relative to housing 610 by bearing 612. Therefore, shaft 602 can freely rotate about its longitudinal axis as it is moved along that axis by piston 606.

Referring back to FIG. 5, as the reciprocating speed of the pistons of pump 530 are driven by the motor through speed reducer 520, the stroke of those pistons is controlled by displacement controller 510. Thus, by controlling the speed at which the pump reciprocates and the displacement of each stroke of the pump pistons, the output pressure and flow rate can be regulated.

Fluid end 540 is coupled to the pistons of pump 530 such that fluid is drawn in through suction inlet 560 and expelled through fluid outlet 570. Fluid end 540 may comprise check valve assemblies 580 that interface with the pistons of pump 530, where each check valve 580 is in fluid communication with both inlet 560 and outlet 570. The check valve assemblies 580 allow fluid to be drawn only from the low pressure inlet 560 and high pressure fluid output only through outlet 570.

By eliminating the need for a heavy-duty, multi-speed transmission, the variable displacement pumping system provides a smaller package for a given pump rating. The table below lists various examples of pumping systems operating at 275 revolutions per minute.

| HHP | Plunger dia. inch | Max Stroke inch | Number Cyl | Max Rate bpm | Rod load lbf | Max Pressure psi |
|---|---|---|---|---|---|---|
| 800 | 4.5 | 8 | 3 | 10.8 | 180000 | 11300 |
| 1000 | 4 | 10 | 3 | 10.7 | 180000 | 14300 |
| 2000 | 4.5 | 12 | 5 | 27.0 | 250000 | 15700 |
| 3000 | 5 | 12 | 3 | 20.0 | 300000 | 15300 |

The smaller package allows higher capacity pumping systems to be mounted on chassis, trailers, or skids comparably sized to smaller pumping systems. The variable displacement pumping system also provides a more complete operating envelope as compared to conventional transmission systems.

While exemplary embodiments of this invention have been shown and described, modifications thereof can be made by one skilled in the art without departing from the scope or teaching of this invention. The embodiments described herein are exemplary only and are not limiting. Many variations and modifications of the system and apparatus are possible and are within the scope of the invention. For example, the relative dimensions of various parts, the materials from which the various parts are made, and other parameters can be varied, so long as the apparatus retain the advantages discussed herein. Accordingly, the scope of protection is not limited to the embodiments described herein, but is only limited by the claims that follow, the scope of which shall include all equivalents of the subject matter of the claims.

What is claimed is:

1. A wellbore pumping system comprising:

a motor, wherein said motor has an operating speed;

a pump coupled to said motor, wherein said pump has a volumetric displacement;

a fluid end coupled to said pump, wherein said fluid end is operable to draw a fluid from an input and provide the fluid to an output that is in fluid communication with a wellbore;

a control system operable to regulate said motor and said pump in order to provide the fluid to the output at a selected pressure and flow rate within a continuous range of pressures and flow rates between a peak horsepower output and a peak torque output of said motor; and a displacement controller coupled to said pump and operable to vary the volumetric displacement of said pump, wherein said displacement controller comprises a hydraulic cylinder and a coupler operable to axially translate a rotating shaft, wherein the axial translation of the rotating shaft varies a stroke of the pump.

2. The wellbore pumping system of claim 1 wherein said control system regulates the operating speed of said motor.

3. The wellbore pumping system of claim 1 wherein said control system regulates the volumetric displacement of said pump.

4. The wellbore pumping system of claim 1 wherein said control system regulates the operating speed of said motor and the volumetric displacement of said pump.

5. The wellbore pumping system of claim 1 wherein said pump is a positive displacement pump having a variable displacement.

6. The wellbore pumping system of claim 1 wherein the volumetric displacement of said pump is variable by changing the stroke of the pump.

7. The wellbore pumping system of claim 5 wherein said control system regulates the operating speed of said motor and the volumetric displacement of said pump.

8. The wellbore pumping system of claim 1 wherein the pump operates at a selected speed and a ratio of the operating speed to the selected speed is fixed.

9. The wellbore pumping system of claim 8 further comprising a speed regulator coupled between said motor and said pump.

10. A pumping system comprising:

a motor having a first operating speed;

a variable displacement pump coupled to said motor, wherein said variable displacement pump has a second operating speed that is related to the first operating speed by a fixed ratio, and wherein said variable displacement pump comprises a rotating shaft having an axial position that determines a displacement of the variable displacement pump;

a fluid end coupled to said variable displacement pump, wherein said fluid end is operable to draw a fluid from an inlet and provide the fluid to an outlet that is in fluid communication with a wellbore;

a control system operable to regulate the operating speed of said motor and the displacement of said variable displacement pump so as to control a pressure and a flow rate of the fluid provided to the outlet; and a displacement controller operable to regulate the axial position of the rotating shaft, wherein said displacement controller comprises a coupler engaged with the rotating shaft and a hydraulic cylinder operable to engage the coupler so as to axially translate the rotating shaft.

11. The pumping system of claim 10 wherein the pumping system is transportable.

12. The pumping system of claim 10 wherein the displacement controller is aligned with the rotating shaft.

13. The pumping system of claim 10 wherein the rotating shaft is positionable at a zero-rate pumping position in which a stroke length of the variable displacement pump is substantially zero.

14. The pumping system of claim 13 wherein the displacement controller further comprises a spring biasing a piston towards the zero-rate pumping position.

15. The pumping system of claim 10 wherein the coupler comprises:

a housing;

a plurality of bearings disposed within the housing; and a retainer coupled to the bearings and the rotating shaft, the retainer configured to rotate relative to the housing.

16. The pumping system of claim 10 further comprising:

a speed reducer coupled to the motor and the rotating shaft, the speed reducer configured to maintain a fixed rotational ratio between the motor and the rotating shaft.

17. The pumping system of claim 16 wherein the pumping system does not comprise a transmission.

18. The pumping system of claim 16 wherein the control system regulates the displacement of said variable displacement pump using the displacement controller, and wherein the control system is configured to optimize a horsepower, a torque, a fuel efficiency, or combinations thereof of the motor by controlling the motor and the displacement controller.

19. The pumping system of claim 10 wherein the fluid end comprises a check valve coupled to the inlet and the outlet.

20. The pumping system of claim 10 wherein the variable displacement pump further comprises a connecting assembly comprising:

a flywheel having a central region and a peripheral region, wherein the central region is coupled to the rotating shaft; and a transition arm having a proximate end and a distal end, wherein the proximate end is coupled to the peripheral region, and wherein the distal end is coupled to a piston.

21. The pumping system of claim 20 wherein the distal end is coupled to a pair of the pistons.

22. The pumping system of claim 10 further comprising a skid, a trailer, or a chassis.

* * * * *